US005421568A

United States Patent [19]

Linder

[11] Patent Number: 5,421,568

[45] Date of Patent: Jun. 6, 1995

[54] INSERTING MACHINE

[75] Inventor: Heinz Linder, Zofingen, Switzerland

[73] Assignee: Grapha-Holding, Hergiswil, Switzerland

[21] Appl. No.: 65,646

[22] Filed: May 21, 1993

[30] Foreign Application Priority Data

Jun. 1, 1992 [CH] Switzerland ..... 01748/92

[51] Int. Cl.[6] ..... B65H 5/30

[52] U.S. Cl. ..... 270/57; 270/55

[58] Field of Search ..... 270/55, 57

[56] References Cited

U.S. PATENT DOCUMENTS 4,743,005 5/1988 Reist ..... 270/55
5,050,851 9/1991 Eugster ..... 270/55
5,292,110 3/1994 Honegger ..... 270/55

FOREIGN PATENT DOCUMENTS 0336062 10/1989 European Pat. Off. .

*Primary Examiner*—Edward K. Look
*Assistant Examiner*—John Ryznic
*Attorney, Agent, or Firm*—Friedrich Kueffner

[57] ABSTRACT

An inserting machine has a plurality of successively arranged feeder heads mounted along two parallel travel paths. In a main jacket feeding station, main jackets are inserted fold first into the feeder heads. The main jackets are opened and one or more insert feeding stations insert inserts into the main jackets. For increasing the output of the inserting machine, the insert feeding station is constructed for selectively feeding inserts to the feeder heads of both parallel travel paths.

4 Claims, 1 Drawing Sheet

INSERTING MACHINE

BACKGROUND OF THE INVENTION

1. Field of the Invention

The present invention relates to an inserting machine includes a plurality of feeder heads or pockets which are driven along two parallel paths. The feeder heads are arranged at uniform distances from each other and printed products can be fed into the feeder heads from above. At the front ends of the two parallel paths are provided a main jacket feeding station each and means for opening the main jackets which have been placed in the feeder heads with the fold first. Insert or pre-printed section feeding stations are arranged in front of removal stations which are located at the discharge ends of the paths.

The feeder heads may revolve, for example, in vertical planes and feeding may be carried out from a coil through a conveyor which is arranged following a feeder.

2. Description of the Related Art

An inserting machine of the above-described type is known, for example, from EP-B1 0336 062. This inserting machine includes means for opening the main jackets placed in the feeder heads before the inserts or pre-printed sections are inserted.

An inserting machine of the above-described type and the auxiliary units required for a complete plant, such as, insert stations and opening stations, are very expensive to acquire. An enlargement of the plant for using additional insert stations is very difficult to realize and hardly provides a better result with respect to efficiency, especially since it is in many cases not possible to adapt in an efficient manner an inserting machine which has a fixed length to the requirements of specific orders.

SUMMARY OF THE INVENTION

Therefore, it is a primary object of the present invention to provide an inserting machine which can be used in an optimum manner with respect to the processing sequence for obtaining a higher production output or to make possible a selective use of the plant.

In accordance with the present invention, the inserting machine of the above-described type includes an insert or pre-printed section feeding station which is constructed for selectively feeding the inserts or pre-printed sections to the feeder heads of the two parallel paths.

As a result of the present invention, it is possible to adapt the inserting machine closely to process different orders and the inserting machine can be manufactured at considerably lower costs as compared to the past.

Thus, an order can be processed by utilizing two paths and, therefore, the output can be doubled.

In accordance with an advantageous feature of the present invention, if an insert or pre-printed section feeding station is used which can be subsequently added and is arranged on the side of one of the paths and is composed essentially of a separating device or a feeder and a transporting or conveying unit following the feeder, the insert or pre-printed section feeding station has a transporting or conveying unit which extends from one side of one path of the inserting machine to the opposite path.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described a preferred embodiment of the invention.

DETAILED DESCRIPTION OF THE PREFERRED EMBODIMENT

Figure 1:
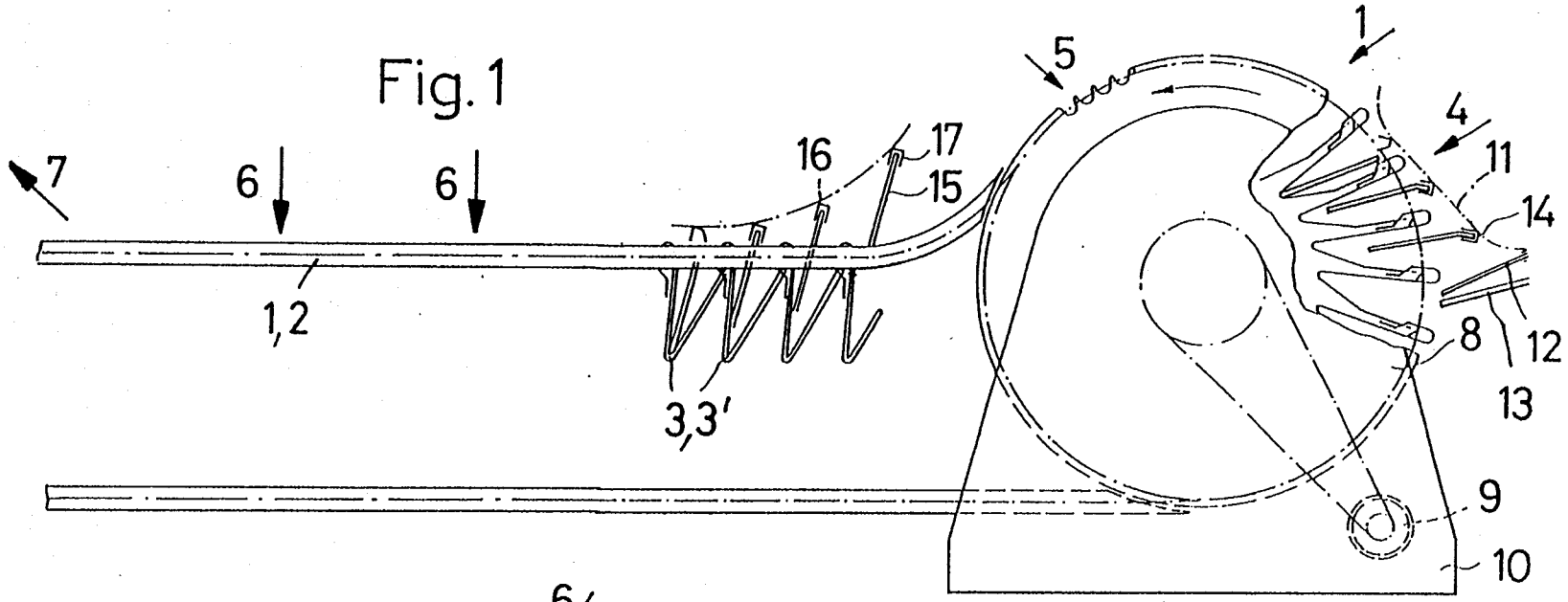
FIG. 1 is a schematic side view of the inserting machine according to the present invention.
Figure 2:
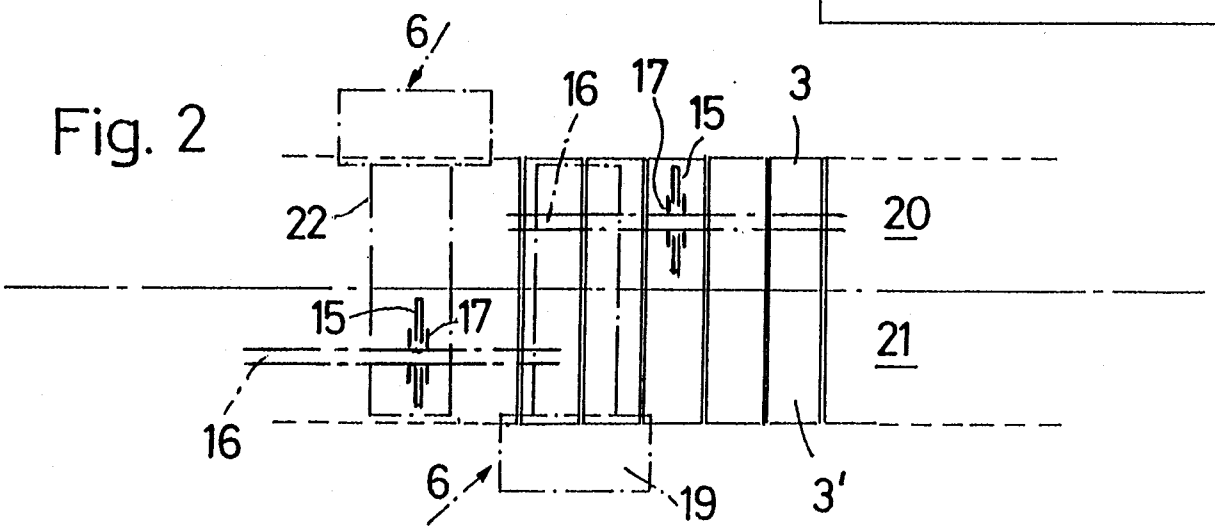
FIG. 2 is a schematic top view of the inserting machine.

The inserting machine 1 illustrated in the drawing has two parallel endless chains 2. Feeder heads 3 are mounted between the endless-chains 2. The feeder heads 3 may be arranged with or without spacing therebetween. The chains 2 guide the feeder heads 3 along an endless path on which are provided successively a main jacket feeding station 4, an opening station 5, at least one insert or pre-printed section inserting station 6 and a removal station 7.

If the inserts or pre-printed sections are to be inserted into one another, they must be opened by appropriate devices after insertion into the feeder heads.

The opening station 5 of the inserting machine 1 includes a twin chain wheel 8 provided with means for opening the printed sheets or products, particularly the main jackets, which have been placed in the feeder heads 3. The twin chain wheel 8 is mounted in a stand 10 and is driven by a motor 9.

The chains 2 are provided with laterally projecting axles. Rollers which travel in guides are mounted on the axles. The feeder heads 3 are fastened on feeder head supports which are fixedly connected to the axles.

During operation, the feeder heads 3 are supplied on the lower portions of the chains 2 toward the twin chain wheel 8. On the circumferential travel path of the chain wheels 8, the feeder heads 3 which are open toward the outside or toward the top travel through the main jacket feeding station 4. In the main jacket feeding station 4, a chain conveyor 11 which is driven with the same cycles as the twin chain wheel 8 feeds a so-called main jacket or main product 12 (printed sheet, printed product), into the feeder heads 3. The main jackets 12 drop with the fold downward over a guide plate 13 into the feeder heads 3 after they have been separated from gripping members 14. Subsequently, after reaching the opening station 5, the main jacket 12, which is aligned or placed against one side of the feeder head 3, is opened in the center thereof for a first insert by means of an appropriate mechanism, as described in the above-mentioned EP-B1-0336 062.

An insert inserting station 6 follows each opening station 5. The discharge end of a chain conveyor or transporter 16 is located at each of the insert inserting stations 6. The chain conveyor or transporter 16 has gripping members 17 which approach the feeder heads 3 in a synchronous cycle.

When traveling through the area closest to the feeder heads 3, the inserts 15 are released by the gripping member 17, so that the inserts 15 drop into the main jackets 12 which are placed open in the feeder heads 3.

Subsequently, additional insert or pre-printed section feeding stations 6 may feed further inserts 15 into the feeder heads 3. The further inserts 15 can either be placed in the main jackets 12 side by side with the previously inserted inserts 15 or they may be inserted into the previously inserted inserts 15. In the latter case, an appropriate mechanism is required for opening the previously inserted insert 15.

In a removal station 7 following the last insert station 16, the main jackets 12 filled with the inserts 15 are taken out of the feeder heads 3 by means of tongs which travel at the same cycle as the feeder heads 3 on a conveying means. Before the main jackets 12 filled with inserts 15 are removed, from the feeder heads 3, they are pressed together by means of a suitable arrangement.

The feeder heads of the inserting machine 1 are constructed in the lateral direction to be used twice, i.e., in addition to and adjacent the first path with feeder heads 3, a second parallel path is provided on which feeder heads 3' are mounted.

The feeder heads 3, 3' operate in the same manner and are equipped with a common drive.

Main jacket feeding stations 4, 4' are provided for the paths 20, 21 in order to feed the products from the top into the feeder heads 3, 3'. The stations 4, 4' are followed by insert or pre-printed section feeding stations 6 which can be subsequently added to the machine and are arranged laterally next to the paths 20, 21. The stations 6 are composed essentially of a separating device or feeder 19 and a subsequently arranged transporter or conveying unit. The stations 6 are constructed in such a way that selectively either of the feeder heads 3, 3' of one of the paths 20, 21 can be supplied with a product.

For this purpose, the insert or pre-printed section feeding station 6 has a transporter 16 or similar conveying unit which extends from one side of one path 20, 21 to the adjacent path 21, 20 for conveying into either one of the paths 20 and 21. The transporter 16 is mounted on an adjustable cantilever-type frame 22.

The invention is not limited by the embodiments described above which are presented as examples only but can be modified in various ways within the scope of protection defined by the appended patent claims.

I claim:

1. An inserting machine for inserting inserts into main jackets, the inserting machine comprising an endless conveying means having two parallel travel paths, a plurality of feeder heads mounted on the endless conveying means for travel along .the two parallel travel paths, the feeder heads being mounted on the endless conveying means, the feeder heads being positioned adjacent to each other with no spacing therebetween or positioned having uniform spacing therebetween, the two parallel travel paths having front ends and discharge ends, a main jacket feeding station at each front end for feeding main jackets fold first into the feeder heads, means for opening the main jackets in the feeder heads, and an insert feeding station arranged in front of a removal station at each discharge end of the travel paths, the insert feeding station comprising means for selectively feeding inserts to the feeder heads of either one of the two parallel travel paths.

2. The inserting machine according to claim 1, wherein the insert feeding station is mounted laterally on a side of one of the two parallel travel paths, the insert feeding station comprising a separating device, the means for selectively feeding inserts comprising a conveying member and means for extending the conveying member from the side of the one path to the adjacent parallel other path.

3. The inserting machine according to claim 2, further comprising a cantilever-type frame, the conveying member being fastened on the cantilever-type frame.

4. The inserting machine according to claim 3, wherein the frame comprises an adjustable cantilever portion.

* * * * *